US006361286B1

(12) United States Patent
Takahashi et al.

(10) Patent No.: US 6,361,286 B1
(45) Date of Patent: Mar. 26, 2002

(54) FUEL PUMP

(75) Inventors: Yukio Takahashi; Hideki Machimura, both of Hitachinaka; Yoshikazu Hoshi, Tokai-mura, all of (JP)

(73) Assignees: Hitachi, Ltd, Tokyo; Hitachi Car Engineering Co., Ltd., Hitachinaka, both of (JP)

( * ) Notice: Subject to any disclaimer, the term of this patent is extended or adjusted under 35 U.S.C. 154(b) by 0 days.

(21) Appl. No.: 09/538,484

(22) Filed: Mar. 30, 2000

Related U.S. Application Data

(63) Continuation of application No. 08/925,731, filed on Sep. 9, 1999, now Pat. No. 6,098,519.

(30) Foreign Application Priority Data

Sep. 9, 1996 (JP) ..... 8-238039

(51) Int. Cl.[7] ..... F04B 27/08
(52) U.S. Cl. ..... 417/269; 74/18; 92/34
(58) Field of Search ..... 417/269, 271, 417/433, 435; 74/25, 18; 92/34, 71

(56) References Cited

U.S. PATENT DOCUMENTS 4,550,630 A * 11/1985 Remus ..... 74/800
5,275,087 A * 1/1994 Akuzawa et al. ..... 92/71
5,782,161 A * 7/1998 Okubo et al. ..... 92/71

FOREIGN PATENT DOCUMENTS

JP 4-209981 7/1992

* cited by examiner

*Primary Examiner*—Tu Ba Hoang
*Assistant Examiner*—Thor Campbell
(74) *Attorney, Agent, or Firm*—Crowell & Moring LLP

(57) ABSTRACT

The drive part for converting the revolution movement to the wobble movement is composed of the shaft for transmitting the drive force from outside, the swash plate rotated by the shaft and the wobble plate for converting the revolution movement of the swash plate to the wobble movement. Plural pistons are reciprocated in responsive to the wobble movement of the wobble plate. The crank room containing the swash plate, the wobble plate and the piston is separated into the fuel room and the drive room by the bellows. The bearings for transmitting the drive force between the shaft in the drive room and the swash plate, and the bearing for transmitting the drive force between the swash plate and the wobble plate are placed inside the drive room in order to lubricate the bearings. By arranging plural pistons inside the fuel room, the fuel is forced to be taken in and discharged by the reciprocate movement of the individual pistons.

4 Claims, 7 Drawing Sheets

FUEL PUMP

This application is a continuation of application Ser. No. 08/925,731 filed Sep. 9, 1999 now U.S. Pat. No. 6,098,519.

BACKGROUND OF THE INVENTION

The present invention relates to a fuel pump, specifically to a fuel pump applicable for a high pressure fuel pump for the direct gas injection system for automotive gasoline engines.

In the internal combustion engines, especially, automotive gasoline engines, the direct gas injection system has been studied in recent years for the purpose of the improvement of the fuel consumption performance, the reduction of the harmful exhaust gas and the improvement of the drive performance and the acceleration performance.

In the direction gas injection system, in order to inject directly gasoline into the cylinders of the internal combustion engine even when the compress ion stroke, a high pressure fuel pump which can supply gasoline with the high pressure, for example, more than 3 MPa is required.

In case of using gasoline for the lubrication of the drive part and the sealing of the rotor shaft of the fuel pump, as the viscosity of gasoline is extremely smaller than that of general purpose lubricating oil, the age of the rotational load support part of the drive part, especially, the age of the bearing becomes extremely short, and the reliability of the sealing mechanism of the rotor shaft becomes low.

In order to solve the above problem, as shown in Japanese Patent Laid Open No. 4-209981 (1992), what is known is the fuel pump in which the pressure-up of the fluid can be facilitated easily by using secondary fluid having higher viscosity and lubrication properties, and the operation fluid can be pressurized up by the piston through the bellows, as well as the lubrication of the load support part such as bearing is performed by the secondary fluid, and the sealing mechanism of the rotor shaft can be established by the secondary fluid.

However, as the number of pistons in the fuel pump described in Japanese Patent Application Laid-Open No. 4-209981 (1992) is only one, the pressure pulsation of the supplied fluid becomes larger. For the direct gas injection apparatus, it is required to establish the minimum fluctuation of the pressure of the supplied fuel with respect to the pressure control accuracy and response of the injected fuel and the flexible condition for the injection time selection. Although it is desirable to make the configuration of the piston multi-cylinder in order to make smaller the pressure pulsation, there has been such a problem that the size of the fuel pump is larger in the configuration that a bellows are placed for the individual piston as shown in Japanese Patent Application Laid-Open No. 4-209981 (1992).

SUMMARY OF THE INVENTION

An object of the present invention is to provide a fuel pump which has high reliabity and which is minitualized, and with small pressure pulsation by lubricating the drive part using lubricating fluid.

In order to attain the above object, the fuel pump of the present invention has a shaft for transmitting a driving force given outside; a swash plate rotated by the shaft; a wobble plate for converting revolution movement of the swash plate; a plurality of pistons reciprocating by wobble movement of the wobble plate; and a bulkhead for separating a fuel room and a drive room in a crank case for containing the swash plate, the wobble plate and the pistons, where with a configuration that a bearing for transmitting driving force between the shaft and the swash plate and a bearing for transmitting driving force between the swash plate and the wobble plate are placed in the drive room, those bearing are lubricated; and with a configuration that the plurality of pistons are placed in the fuel room, the fuel is intaken and discharged by the individual pistons.

With this configuration, a highly reliable and low pressure pulsation and small fuel pump can be obtained.

In the above described fuel pump, the bulkhead is configured with a bellows in which an inside of the bellows is supplied as a fuel room, and an outside of the bellows is supplied as a drive room. With this configuration, the leakage of the fuel can be protected.

According to another aspect of the present invention, the fuel pump has a shaft for transmitting a driving force given outside; a swash plate rotated by the shaft; a wobble plate for converting revolution movement of the swash plate; a plurality of pistons reciprocating by wobble movement of the wobble plate; and a bulkhead for separating a crank case composed of a front body and a cylinder block for containing the swash plate, the wobble plate and the pistons into two independent rooms, a part of the bulkhead being fixed at the wobble plate.

With this configuration, a highly reliable and low pressure pulsation and small-sized fuel pump can be obtained.

In the above described fuel pump, one of the two independent rooms separated by the bulkhead is supplied as a fuel room; and with a configuration that an inlet port and an inlet valve of the piston is placed in said fuel room, the fuel is directly supplied from the fuel room into a cylinder room of the piston.

In the above described fuel pump, a slipper is defined between the wobble plate and the piston, in which the contact surface of the slipper to the wobble plate is substantially a flat plane, and the contact surface of the slipper to the piston is a sphere; and the slipper has a channel connected to the inlet port of the piston and the connecting port connected to the channel on the plane surface of the slipper.

DETAILED DESCRIPTION OF THE PREFERRED EMBODIMENTS

Now, referring to FIGS. 1 to 3, the fuel pump of a first embodiment of the present invention will be described.

Figure 1:
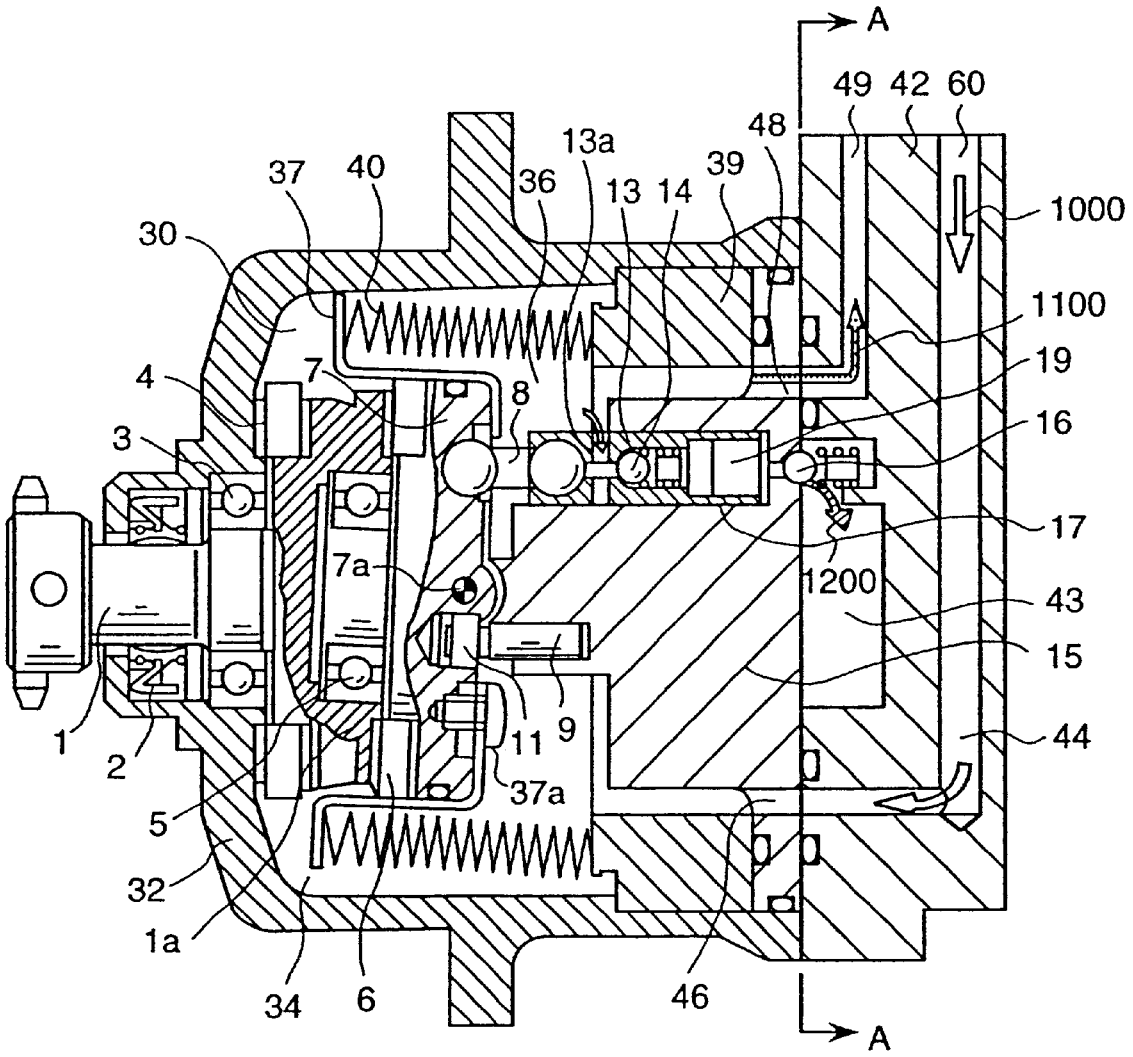
FIG. 1 is a cross section view of the fuel pump of a first embodiment of the present invention.

FIG. 1 is a cross section view of the fuel pump of the first embodiment of the present invention.

The shaft 1 is connected to the cam shaft and so on of the engine, not shown, in order to transmit the driving force. At the end of the shaft 1, there is a swash plate 1*a* for generating the wobble motion by using the revolution movement of the shaft 1. The shaft 1 is supported by the radial bearing 3 and the thrust bearing 4 in order to establish the free revolution movement relative to the front body 32.

The wobble plate 7 is connected to the swash plate part la through the radial bearing 5 and the thrust bearing 6. The wobble plate 7 generates the wobble movement in responsive to the revolution movement of the swash plate part 1*a* the shaft 1. bellows 40 is mounted at the bellows ring 39 fixed at the cylinder block 15. The bellows 40 separates the crank room 30 into two rooms; the drive room containing the mechanical parts for converting the revolution movement of the shaft 1 to the wobble movement, and the fuel room 36 filled with the gasoline used as the working fluid. Oil and grease used for lubricating the mechanical parts are filled in the drive room 34. The bellows 40 and the bellows cap 37, and the bellows 40 and the bellows ring 39 are fixed by TIG (Tungsten Inert Gas) Welding or Plasma Welding. As for the material used for the bellows 40, as the bellows contact directly to the gasoline, the corrosion resistance material such as austenite-base stainless steel is used. Austenite-base stain less steel includes, for example, SUS304, SUS304L, SUS316 and SUS316L.

The bellows 40 is a formed material shaped in a letter U. As for the fabrication method of the bellows, there are two categories; molded bellows and welded bellows. From the viewpoint of mass productivity, it is required to use molded bellows in automotive applications. As the bellows is used as the seal materials for the part under wobble movement, in order to reduce the stress concentration at the peak and bottom part of the bellows under wobble movement, the crest radius of the peak and bottom part is required to be large and hence, U-letter shaped bellows is used. Thus, by using the U-letter molded bellows, the stress generated at the bellows can be reduced as much as possible.

In this embodiment, the wobble center 7*a* of the wobble plate is defined to be located inside between the both end parts of the The wobble plate 7 transmit only the reciprocate movement obtained from the revolution friction and thrust friction generated by the radial bearing 5 and the thrust bearing 6 to the piston 13 through the conrod 8, by limiting the rotational movement with the joint pin 9 and the joint ball 11. The piston 13 is guided in the cylinder bore 17 placed in the cylinder block 15, and forms the cylinder room 19 used for pump compression by the reciprocate movement. As described later by referring to FIG. 2, there are 5 pistons in this embodiment, and thus, the fuel pump is so configured as to form a 5-cylinder engine.

The piston 13 has a intake valve 14. When the piston 13 goes to the intake stroke, the intake valve 14 opens and the gasoline taken in through the intake route 13*a* formed in the piston 13 is taken into the cylinder 19. The rear body 42 has an discharge valve 16. When the piston 13 moves in the right direction in FIG. 1, the discharge valve 16 opens and the gasoline staying in the cylinder 19 is discharged out to the high pressure room 43.

What is formed inside the front 32 is the crank room 30 composed of the front body 32 and the cylinder block 15. In the crank room 30, contained are radial bearing 3 and 5, thrust bearings 4 and 6, the wobble plate 7, the shaft 1 and the piston 13 moving in the reciprocative manner while contacting to the wobble plate 7.

The bellows caps 37 are fixed with the screws 37*a* on the outer ridge of the wobble plate 7. One end side of the bellows 40 is mounted at the bellows cap 37, and other end side of the bellows 40 in the longitudinal direction (axial direction) of the bellows. Therefore, the length of the bellows 40 can be taken to be longer than the stroke of the reciprocal movement of the piston 13, the stress generated at the peak and/or bottom part of the bellows 40 can be reduced.

As the axial center of the individual end parts of the bellows 40, the axial center of the wobble plate 7 and the axial center of the shaft 1 are substantially defined to be identical to one another, the stress generated at the bellows 40 are made to be identical over all the peaks and bottoms. With this structure, the repetitive stress generated at the bellows by the wobble movement of the wobble plate 7 in responsive to every single rotation of the pump is made to be reduced, and the stress generated at the individual peak part is made to be identical to each other, and the stress generated at the individual bottom part is made to be identical to each other. This identical stress defined as above is made to be under the fatigue limit for the material used for the bellows.

In order to reduce the stress generated by the vertical displacement of the bellows, the wobble center is made to be identical to the center of the bellows in its longitudinal direction.

The oil seal 2 is installed between the shaft 1 and the front body 32, and the O-ring is installed between the bellows cap 37 and the wobble plate 7 in order to seal the drive room 34. The lubrication oil is supplied into the drive room 34 from the oil inlet port not shown but formed in the front body 32.

The rear body 42 is fixed at the front body 32 with bolts while the bellows block 39 and the cylinder block 15 are inserted into the front body 32. The gasoline pressurized at 0.3 MPa by the feed pump mounted inside the fuel tank is taken into the rear body 42, in which the intake route 44 connected to the intake port 60, the high pressure room 43 containing the highly pressurized gasoline at 3 MPa or more by the five pistons 13, and the air vent route 49 for separating and exhausting the intake air are formed. The high pressure room 43 is connected to the discharge route to be described later by referring to FIG. 2.

Inside the cylinder block 15, the connection route 46 to be connected to the intake route 44 of the rear body 42 and the connecting route 48 connected to the air vent route 49 of the rear body 42 are formed.

The gasoline taken in from the intake port 60 is lead into the fuel room 36 via the intake route 44 and the connection route 46. The connection route 46 through which the gasoline flows is placed at the cylinder block 15 below the connection route 48 connected to the air vent route 49. Therefore, the air contained in the gasoline taken in through the connection route 46 rises up with the floating force and gathers onto the upper part of the fuel room 36, and is discharged outside through the connection route 48 and the air vent route 49.

Thus, in this embodiment, as described later by referring to FIG. 2, in order to discharge the air staying in the fuel room outside the pump, the connection route 48 is placed at the position higher than the location of the most upper intake port to the individual cylinder in the fuel room 36. The connection route 48 is connected to the route 49 extended from the rear body 42 to the outside of the fuel pump. With this configuration, the air staying at the upper part of the fuel room 36 can be discharged outside the fuel pump.

Not shown in FIG. 1, the air vent route 49 placed at the rear body 42 is further connected to the low pressure regulator placed at the upper part and used for regulating the pressure of the intake side, and thus, the vent air goes back to the gasoline tank in which the gas pressure is equivalent to the atmospheric pressure. The fuel room 36 placed inside the crank room has a structure for storing the gasoline containing less air, and at the same time, the intake port 13*a* is placed at the piston 13 so that the gasoline containing less air may be taken into the individual cylinder room, and thus, the gasoline in the fuel room 36 can be directly taken in.

Figure 2:
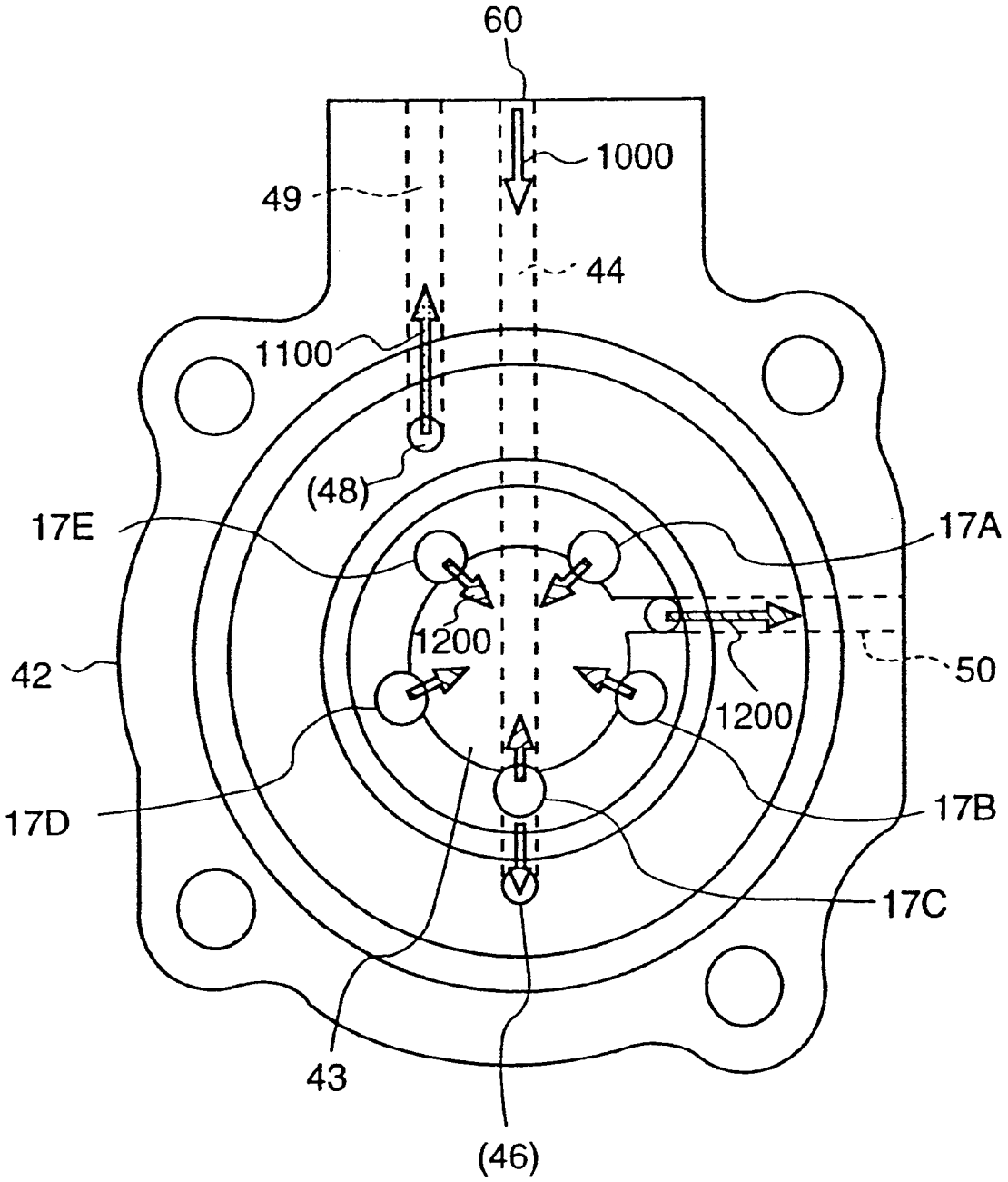
FIG. 2 is a side view of the rear body of the fuel pump of the first embodiment of the present invention, developed along the line A—A shown in FIG. 1.

Next, referring to FIG. 2, the layout configuration of the 5-cylinder piston and the layout configuration of the individual route are described.

FIG. 2 is a side view of the rear body of the fuel pump of one embodiment of the present invention, developed along the line A—A shown in FIG. 1.

The low pressure gasoline taken in from the intake port 60 placed at the upper part of the rear body is lead to the lowest part of the rear body 42 through the intake route 44, and is connected to the connecting route 46 of the cylinder block 15 shown in FIG. 1.

In the rear body 42, five discharge valve open pores 17A, 17B, 17C, 17D and 17E are formed. Five cylinder rooms are formed, each corresponding to the individual discharge valve open pores 17A, 17B, 17C, 17D and 17E, and thus, five pistons are so arranged.

The open pore of the air vent route 49 is placed at the upper part of the rear body 42 and at the position higher than the location of the most upper intake port (corresponding to the discharge valve open pores 17A and 17E) to the individual cylinder room. The connection route 48 of the cylinder block 15 shown in FIG. 1 is connected to this open pore.

The gasoline taken in from the intake port 60 is lead into the fuel room via the intake route 44 and the connection route 46. The connection route 46 through which the gasoline flows is placed below the cylinder block 15, that is, below the main body of the fuel pump, and the connection route 48 connected to the air vent route 49 is placed above the cylinder block 15, that is, above the main body of the fuel pump. Therefore, the air contained in the gasoline taken in through the connection route 46 rises up with the floating force and gathers onto the upper part of the fuel room 36, and is discharged outside through the connection route 48 and the air vent route 49.

The gasoline pressurized by five pistons is discharged out into the high pressure room 43 via the discharge valve open pores 17A, 17B, 17C, 17D and 17E, and furthermore, discharged outside from the discharge route 50.

Figure 3:
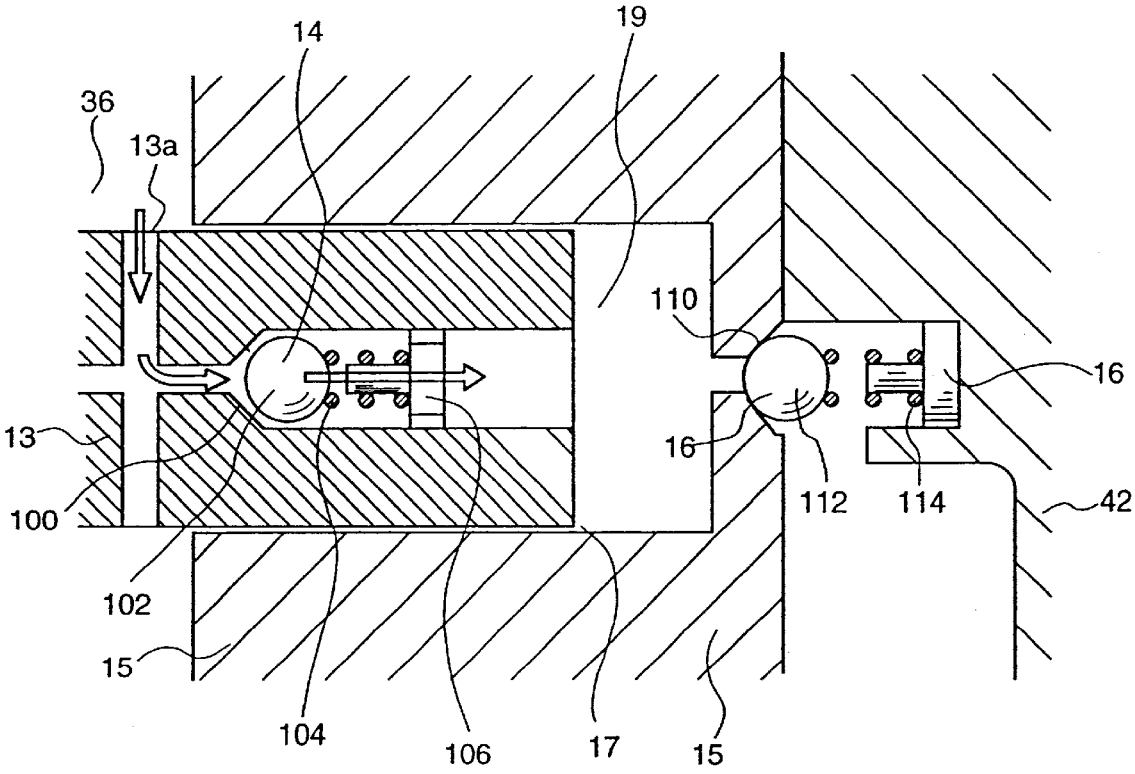
FIG. 3 is an enlarged view of the cross section of the cylinder room of the fuel pump in the first embodiment of the present invention.

Next, referring to FIG. 3, the detail structure of the cylinder room is described.

FIG. 3 is an enlarged view of the cross section of the cylinder room of the fuel pump in one embodiment of the present invention.

The intake valve 14 is formed inside the piston 13. The ball 102 is pressed by the spring 104 against to the 90 valve sheet 100 in the piston 13, and thus, the valve sheet 100 is sealed by the ball 102. In order to regulate the setting load of the spring 104, the valve stopper is fixed at the piston 13.

On the other hand, as for the structure of the discharge valve 16, the ball 112 is pressed by the spring 114 against to the 90 valve sheet 110 defined at the rear body 15 side of the cylinder, and thus, the valve sheet 110 is sealed by the ball 112. In order to regulate the setting load of the spring 114, the valve stopper 116 is fixed at the rear body 15.

When the piston 13 moves in the reciprocate movement along the wobble plate shown in FIG. 1 and then the intake stroke begins, the volume of the cylinder room 17 increases and the pressure in the cylinder room 17 decreases, and next, when the pressure difference between the front and the rear of the sheet of the ball 102 occurs and the valve open force determined by the product of the cross-section corresponding to the sheet diameter and the pressure difference becomes larger than the set load of the spring 104, the ball 102 leaves the sheet 100, and finally, the gasoline is taken into the cylinder room 19 from the intake port 13*a* of the piston 13 opening to the fuel room 36.

When the piston 13 goes into the discharge stroke, the pressure inside the cylinder room 19 increases as the volume of the cylinder room 19 decreases, and the valve close force is applied to the ball 102 in contrast to the valve open force described above, and finally, the ball 102 contacts to the sheet 100 for sealing the open port. At this time, as the pressure inside the cylinder room 19 increases, the pressure difference between the front and the rear of the sheet of the ball 122 of the discharge valve 16 occurs. Next, when the valve open force determined by the product of the cross section corresponding to the sheet diameter and the pressure difference becomes larger than the set load of the spring 114, the ball 112 leaves the sheet 112 and the discharge valve 16 opens, and finally, the gasoline is discharged out to the high pressure room 43 of the rear body 42.

With the above described structure, the pump capacity determined by the regulated stroke length can be efficiently used.

As described above, the wobble plate 7 so configured as to move not in the revolution manner but in the reciprocate manner is made to be one end part of the bellows 40 used as the seal material and the other end part of the bellows isolates at large the multiple-cylinder piston. Therefore, not as in the prior art systems where the bellows is individually placed at every cylinder, the bellows used as the seal material can be reduced. Therefore, the overall structure can be simplified and the size of the fuel pump can be made to be small in comparison with the prior art systems.

The crank room 30 is separated into the drive room 34 and the fuel room 36 by the bellows 40, and the drive room 34 used for converting the revolution movement to the reciprocal movement is filled with the lubrication oil. Therefore, the bearings 3, 4, 5 and 6 in the drive room can be operated in the high-viscosity lubrication oil, and hence, the life of the rolling bearing can be extended, the oil seal 2 used as the seal between the rolling part of the shaft 1 and the outside can be increased, and ultimately, the leakage of the gasoline directly outside can be prevented.

In the structure of this embodiment, the fuel room 36 is defined at the piston side, the intake gasoline is led into the lower part of the fuel room 36, and the air vent route 49 for extracting the air contained in the intake gasoline and discharging outside the pump is placed in the upper part of the fuel room 36. With this configuration, the fuel room can be also used as the air separation room. In case that the air contained in the intake gasoline and the air void generated due to the temperature rise during the pump operation remain in the compression cylinder of the bellows, there may be such a problem that the expected amount of discharged gasoline determined by the regulated stroke length can not be obtained because of the development of the compressive gas, for example, air void in the gasoline. This problem can be resolved by the above described configuration in which the contained air void can be extracted, and hence, the amount of the discharged gasoline from the fuel pump can be kept constant.

In the structure of this embodiment, the gasoline is directly taken in from the fuel room 36 to the cylinder room 19 via the intake port 13*a* formed at the piston 13, the intake valve 14 can be placed at the piston 13. Consequently, the number of O-rings can be reduced in comparison with the structure in which the intake valve and the discharge valve are sealed independently.

The crank room 30 is separated into two independent rooms, the fuel room 36 and the drive room 34, by the bellows 40, and the fuel room 36 is placed inside the bellows 40 and the drive room 34 is placed outside the bellows 40.With this configuration, as the drive room 34 is located outside the fuel room 36, the drive room 34 is used as a gasoline leakage protection room, which leads to an effective means for protecting the leakage of the gasoline outside atmosphere.

As it is required to make the front body 32 have such a structure member as mount device for fixing the pump on the engine, the shape of the front body may be complex. As the front body 32 is provided with the function of sealing the lubrication oil, the casting parts which have ever been generically fabricated with ease but have never been used because of low reliability in porosity handling with low viscosity fluid can be used with higher reliability. Therefore, the productivity of the fuel pump can be increased.

According to this embodiment as described above, the reliability can be made to be higher by lubricating the drive part with the lubricating fluid, and the pressure pulsation can be reduced to be small enough by using multiple-cylinder pistons. In addition, the size of the fuel pump can be reduced with the configuration in which all the multiple-cylinder pistons are isolated at large.

By using the U-letter molded bellows, the stress generated in the bellows can be reduced as much as possible.

The stress generated in the top and bottom part of the bellows can be reduced.

As the drive room for converting the revolution movement to the reciprocating movement is filled with the lubricating oil, the reliability of the drive room can be increased.

By using the structure enabling to extract the air contained in the gasoline, the amount of discharged gasoline from the fuel pump can be kept constant.

By making the piston have an intake valve, the number of O-rings can be reduced.

As the fuel room is located inside the bellows and the drive room is located outside the bellows, the leakage of the gasoline outside atmosphere can be effectively protected. Therefore, casting parts can be used as the material for the front body, and ultimately, the productivity of the fuel pump can be increased.

Figure 4:
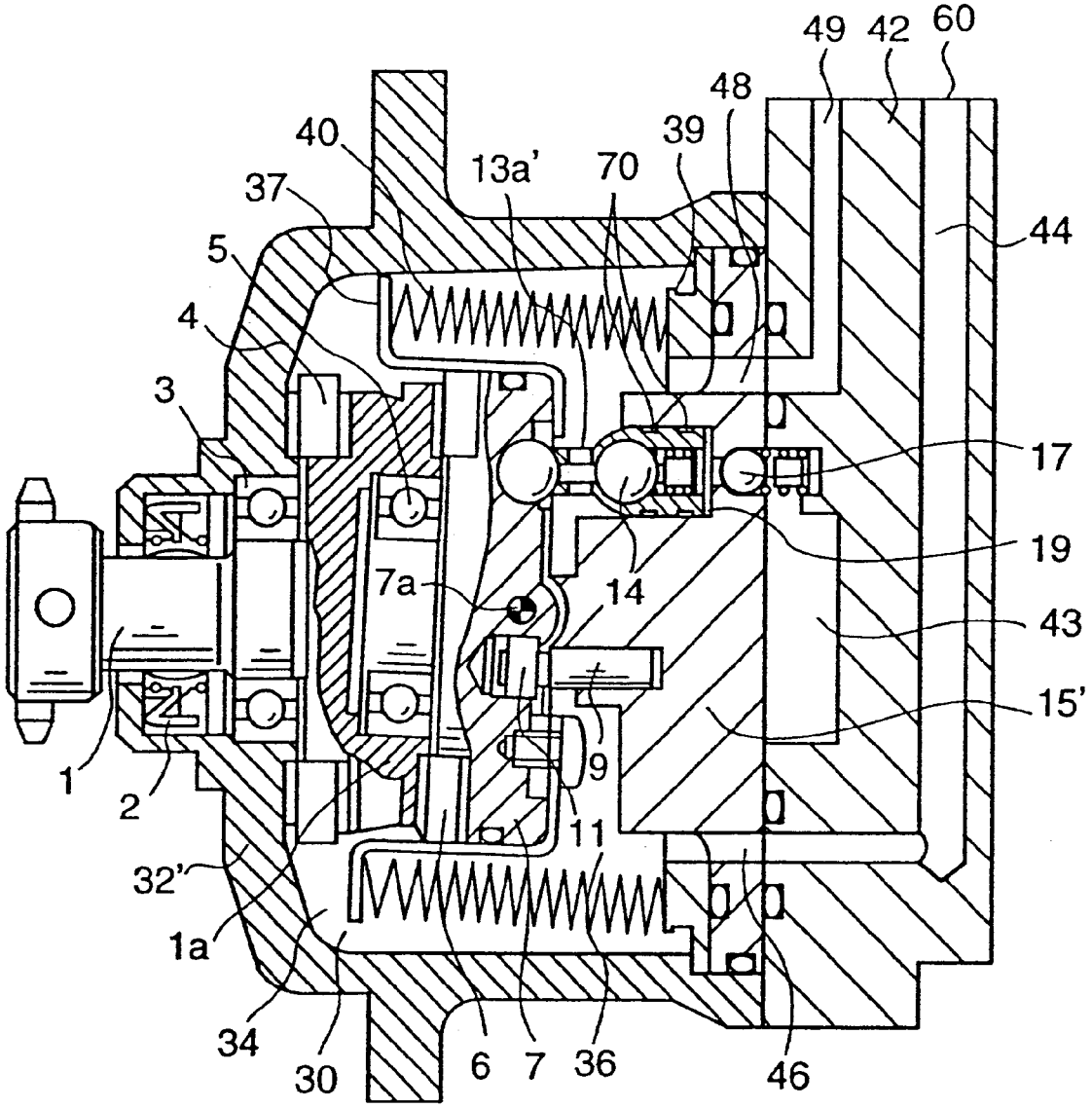
FIG. 4 is a cross section of the fuel pump of a second embodiment of the present invention.

Next, by referring to FIG. 4, the fuel pump in the second embodiment of the present invention is described.

FIG. 4 is a cross section of the fuel pump in the second embodiment of the present invention. The identical parts in FIG. 4 to those in FIG. 1 have identical numerals.

The specific point of this embodiment is that the piston 13' has a piston ring 70. The piston ring 70 is made of the material with its major component being PTFE resin (Poly-Tetra-Floro-Ethylene). Resin material is effective for the material used for the piston ring, because the resin-base material can fit the shape of the cylinder bore in order to keep the sealing effect of the piston ring even in case that the fabrication accuracy of the cylinder bore is not high and that the working fluid is low viscosity gasoline. The resin-base material with its major component being PTFE is especially good for choice in considering the physical state stability and the friction property. By mounting the piston ring made of PTFE on the piston 13', a self-seal effect obtained by the internal pressure generated in the cylinder room 19 can be attained.

In the piston without a piston ring as shown in FIG. 1, a seal effect established only by the gap defined between the piston and the cylinder block is inevitable, and hence, it is required to establish the high precision fabrication with several mm gap between the piston and the cylinder block. On the other hand, in the structure of this embodiment shown in FIG. 2 in which the piston has a piston ring and the piston ring gives a seal effect, as the allowable gap between the piston and the cylinder block bore can be taken to be as large as several ten mm, so high precision fabrication is not required, and ultimately, the productivity can be increased.

As shown in FIG. 1, in case that a seal effect is established only by the gap between the piston without a piston ring and the cylinder block bore, the length of the effective seal part (the length of the friction region defined in the direction of the wobble movement of the piston and the cylinder block) is required to be 10 to 20 mm. In case of using the piston having a piston ring as in this embodiment, the length of the effective seal part is equivalent to the thickness of the piston ring, for example, 2 to 3 mm, which can give enough seal effect. Consequently, the length of the cylinder block 15', the bellows block 39' and the front body 32' measured in their axial direction can be reduced by 15 to 16 mm. Therefore, in case of applying the fuel pump of this embodiment to the gas direct injection apparatus for the automotive engine, the drive force of the cam shaft in the engine room is transmitted to the shaft 1 of the fuel pump. Thus, in case of the space for mounting the fuel pump in the engine room is limited, the short-length fuel pump is effective.

According to this embodiment as described above, the reliability can be made to be higher by lubricating the drive part with the lubricating fluid, and the pressure pulsation can be reduced to be small enough by using multiple-cylinder pistons. In addition, the size of the fuel pump can be reduced with the configuration in which all the multiple-cylinder pistons are isolated at large.

By using the U-letter molded bellows, the stress generated in the bellows can be reduced as much as possible.

The stress generated in the top and bottom part of the bellows can be reduced.

As the drive room for converting the revolution movement to the reciprocating movement is filled with the lubricating oil, the reliability of the drive room can be increased.

By using the structure enabling to extract the air contained in the gasoline, the amount of discharged gasoline from the fuel pump can be kept constant.

By making the piston have an intake valve, the number of O-rings can be reduced.

As the fuel room is located inside the bellows and the drive room is located outside the bellows, the leakage of the gasoline outside atmosphere can be effectively protected. Therefore, casting parts can be used as the material for the front body, and ultimately, the productivity of the fuel pump can be increased.

According to this embodiment, by using the piston ring, the high-precision fabrication is not required, and the productivity can be increased.

In addition, by using the piston ring, the length of the fuel pump measured in the axial direction can be made to be shorter, and the size of the fuel pump can be reduced.

Figure 5:
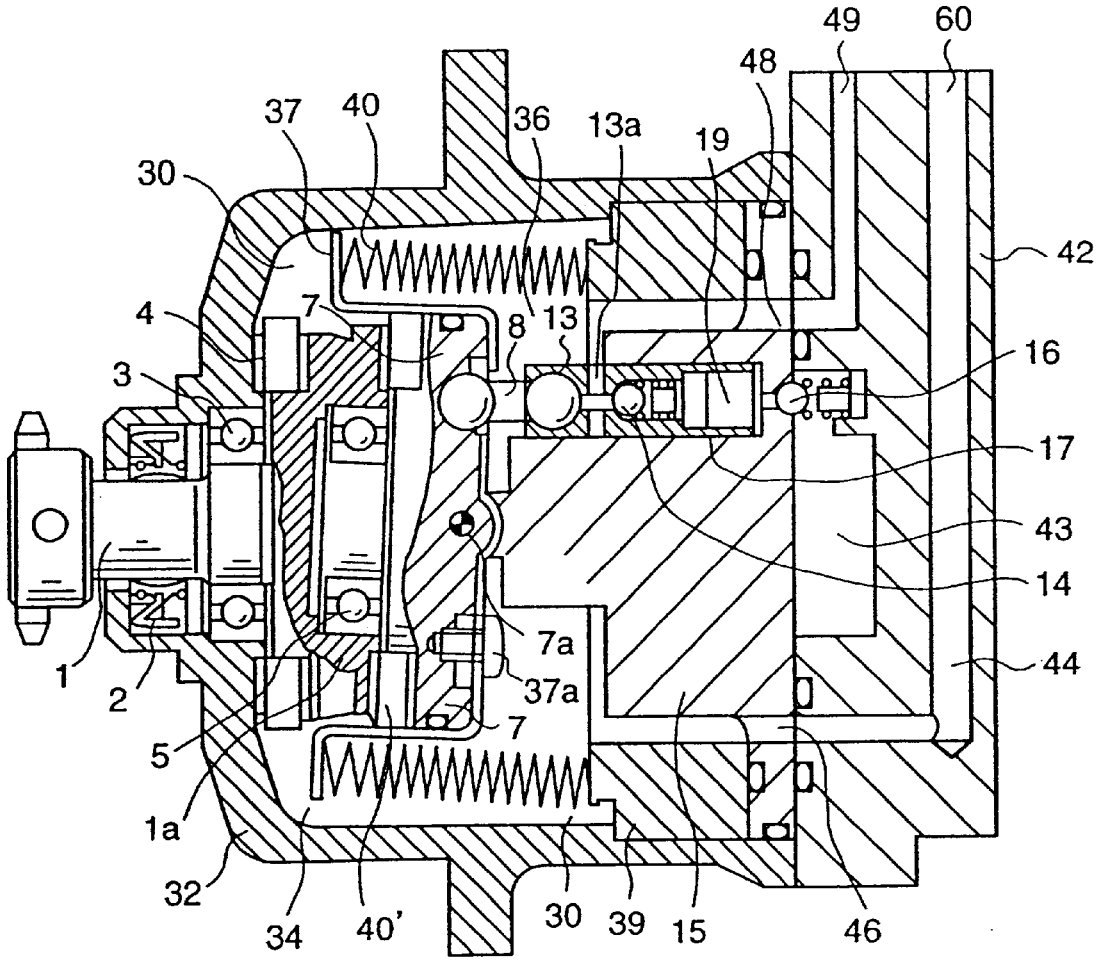
FIG. 5 is a cross section of the fuel pump of a third embodiment of the present invention.

Next, by referring to FIG. 5, the fuel pump in the third embodiment of the present invention is described.

FIG. 5 is a cross section of the fuel pump in the third embodiment of the present invention. The identical parts in FIG. 5 to those in FIG. 1 have identical numerals.

The specific point of this embodiment is that the joint pin 9 and the joint ball 11 shown in FIG. 1 are eliminated. In the embodiment shown in FIG. 1, the revolution and wobble friction is used by the joint pin 9 and the joint ball 11 for preventing the revolution movement of the wobble plate 7.

In contrast, in this embodiment, the prevention of the revolution movement of the wobble plate 7 is established by the torsional rigidity of the bellows 40' without using the joint pin 9 and the joint ball 11. In order to assure this preventive motion, the rigidity of the bellows 40' shown in FIG. 5 is determined to be a little larger than that of the bellows 40 shown in FIG. 1.

With this structure in which the joint pin and the joint ball is not necessary any more, the number of necessary parts can be reduced and the fabrication of the fuel pump is made to be easier.

According to this embodiment as described above, the reliability can be made to be higher by lubricating the drive part with the lubricating fluid, and the pressure pulsation can be reduced to be small enough by using multiple-cylinder pistons. In addition, the size of the fuel pump can be reduced with the configuration in which all the multiple-cylinder pistons are isolated at large.

By using the U-letter molded bellows, the stress generated in the bellows can be reduced as much as possible.

The stress generated in the top and bottom part of the bellows can be reduced.

As the drive room for converting the revolution movement to the reciprocating movement is filled with the lubricating oil, the reliability of the drive room can be increased.

By using the structure enabling to extract the air contained in the gasoline, the amount of discharged gasoline from the fuel pump can be kept constant.

By making the piston have an intake valve, the number of O-rings can be reduced.

As the fuel room is located inside the bellows and the drive room is located outside the bellows, the leakage of the gasoline outside atmosphere can be effectively protected. Therefore, casting parts can be used as the material for the front body, and ultimately, the productivity of the fuel pump can be increased.

In addition, according to this embodiment, the joint pin and the joint ball are not necessary, and hence, he number of necessary parts can be reduced and the fabrication of the fuel pump is made to be easier.

Figure 6:
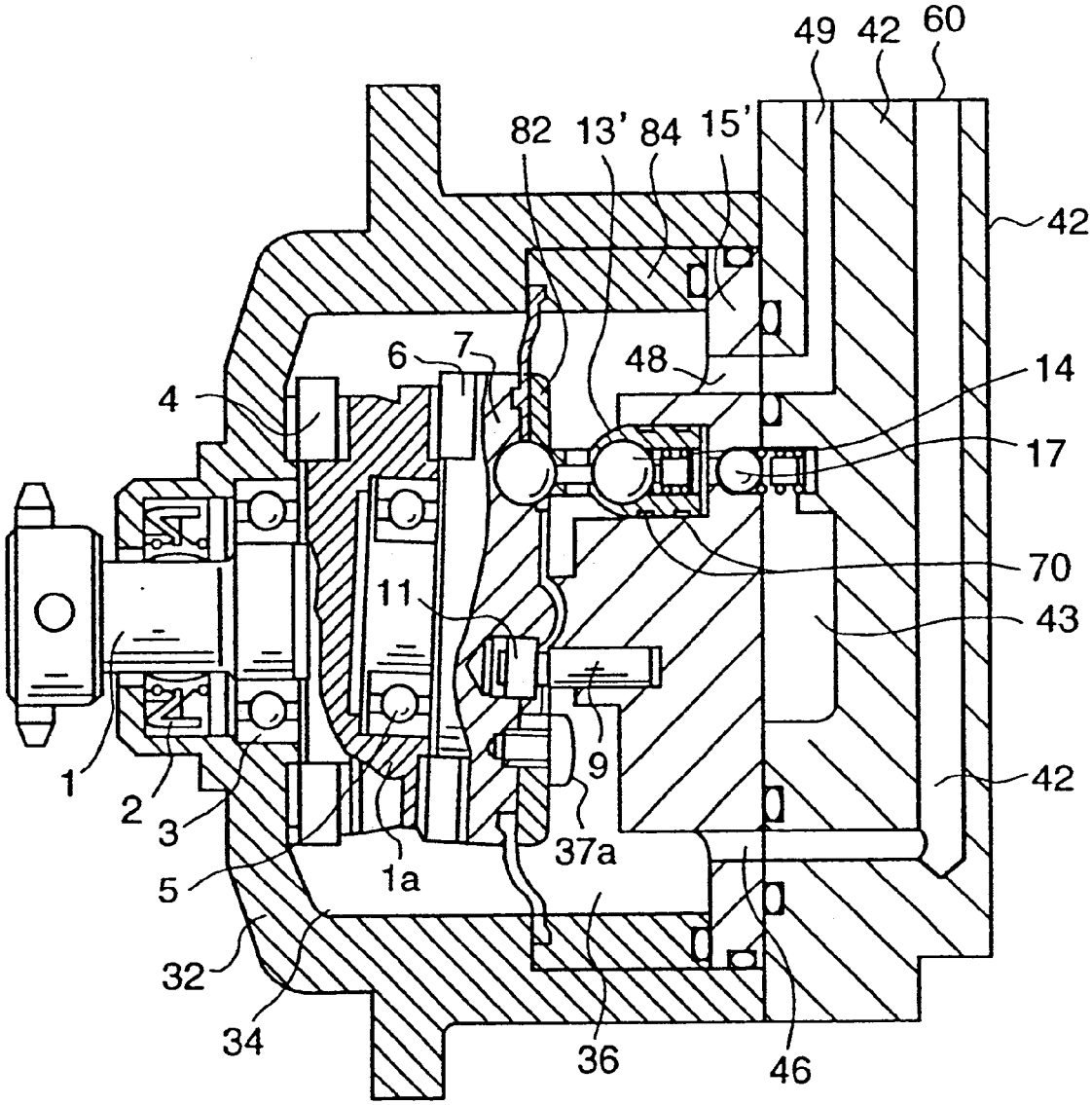
FIG. 6 is a cross section of the fuel pump of a forth embodiment of the present invention.

Next, by referring to FIG. 6, the fuel pump in the forth embodiment of the present invention is described.

FIG. 6 is a cross section of the fuel pump of the forth embodiment of the present invention. The identical parts in FIG. 6 to those in FIG. 4 have identical numerals.

The specific point of this embodiment is that the diaphragm 80 is used as the bulkhead for separating the crank room 30 into the drive room 34 and the fuel room 36. The internal hedge of the diaphragm 80 is inserted between the wobble plate 7 and the rod press 82, and is bound and fixed by the screw 37*a*. The outer hedge of the diaphragm 80 is inserted between the inside of the front body 32' and the diaphragm block 84, and is fixed by bolting up the front body 32' and the rear body 42.

As for the material used for the diaphragm 80, the material which can trace the wobble movement and generates the less stress is optimal, and hence, the rubber material or the PTFE-base material is good for choice. The size of the fuel pump can be reduced by using the rubber material or the PTFE-base material. Though the metallic diaphragm can be used for keeping durable under repetitive wobble movement, the size of the metallic diaphragm may be relatively larger.

Though the both ends of the bellows are required to be welded in the structure in which the bellows shown in FIG. 1 is used, the welding work can be eliminated in this embodiment.

The length of the bellows in its longitudinal direction can be made to be short, and the fabrication of the fuel pump can be made to be much easier.

According to this embodiment as described above, the reliability can be made to be higher by lubricating the drive part with the lubricating fluid, and the pressure pulsation can be reduced to be small enough by using multiple-cylinder pistons. In addition, the size of the fuel pump can be reduced with the configuration in which all the multiple-cylinder pistons are isolated at large.

As the drive room for converting the revolution movement to the reciprocating movement is filled with the lubricating oil, the reliability of the drive room can be increased.

By using the structure enabling to extract the air contained in the gasoline, the amount of discharged gasoline from the fuel pump can be kept constant.

By making the piston have an intake valve, the number of O-rings can be reduced.

As the fuel room is located inside the bellows and the drive room is located outside the bellows, the leakage of the gasoline outside atmosphere can be effectively protected. Therefore, casting parts can be used as the material for the front body, and ultimately, the productivity of the fuel pump can be increased.

In addition, by using the piston ring, the high-precision fabrication is not required, and the productivity can be increased.

In addition, by using the piston ring, the length of the fuel pump measured in the axial direction can be made to be shorter, and the size of the fuel pump can be reduced.

In addition, in this embodiment, by using the diaphragm, the welding work can be eliminated.

The length of the bellows in its longitudinal direction can be made to be short, and the fabrication of the fuel pump can be made to be much easier.

Figure 7:
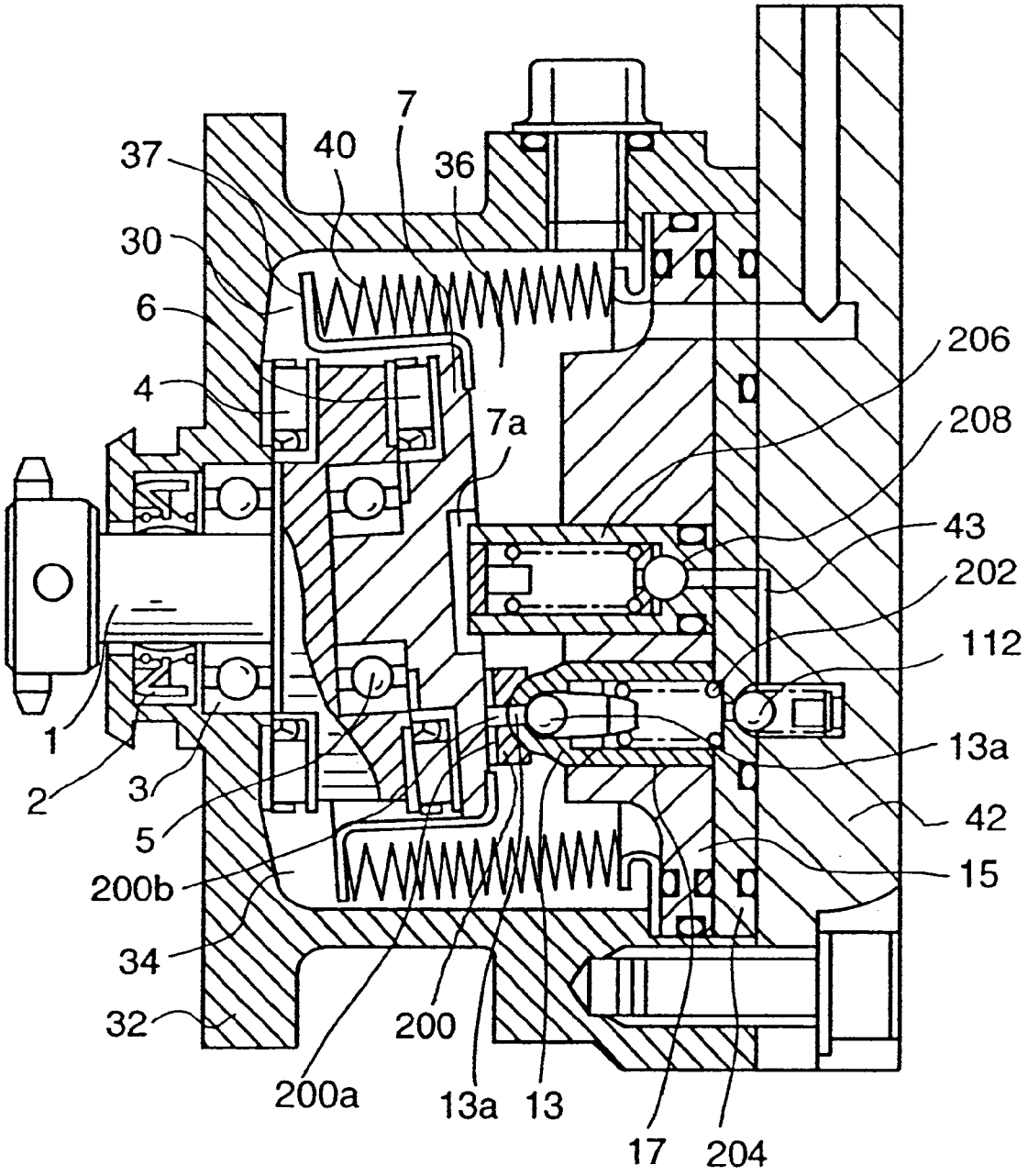
FIG. 7 is a cross section of the fuel pump of a fifth embodiment of the present invention.

Next, by referring to FIG. 7, the fuel pump in the fifth embodiment of the present invention is described.

FIG. 7 is a cross section of the fuel pump of the fifth embodiment of the present invention. The identical parts in FIG. 7 to those in FIG. 1 have identical numerals.

In the embodiment shown in FIG. 1, the piston 13 and the wobble plate 7 are connected to each other by the conrod 7. In contrast, the specific point of this embodiment is that the slipper 200 is formed between the piston 13 and the wobble plate 7. The piston ring 202 is placed in order to made the piston 13 and the slipper 200 contact the wobble plate 7.

The cylinder bore of the cylinder block 15 forms a penetration hole, and the valve sheet 204 forming the sheet part of the ball 112 of the discharge valve is placed between the cylinder block 15 and the rear body 42. In the structure of this embodiment where the cylinder bore 17 is formed as a penetration hole and the penetration hole is partially plugged by the valve sheet 204, the piston 13 can be easily inserted into the cylinder bore 17. Therefore, the fabrication of the fuel pump can be made to be easier.

The intake channel 200*a* for leading the fuel into the piston 13 is formed at the wobble plate side of the slipper 200. The connection port 200*b* connecting to the intake channel 200*a* is formed at the center of the slipper 200. As the slipper 200 can rotate itself freely, the intake channel 200*a* can rotate itself, and hence, the fuel is continuously supplied to the contact part between the bottom face of the slipper 200 and the wobble plate 7. Therefore, as the contact part between the bottom face of the slipper 200 and the wobble plate 7 works as the intake route, the intake channel 200*a* operates effectively with respect to wobble movement.

The intake connection route 13*a* connecting continuously to the slipper connection port 200*b* is placed on the center axis of the piston 13, and the fuel is led to the intake valve 13*a* placed inside the piston 13.

In the above description, the surface of the slipper 200 contacting to the piston 13 is concave and the surface of the piston 13 contacting to the slipper 200 is convex. It is allowed that the surface of the slipper 200 contacting to the piston 13 is convex, and that the surface of the piston 13 contacting to the slipper 200 is concave. In the latter case, the piston 13 can be inserted into the slipper 200 more easily.

The highly-pressurized fuel flowing out from the ball 112 of the discharge valve flows into the high pressure room 43. Though the discharge route for leading the fuel contained in the high pressure room 43 to the outside is not shown in FIG. 7, the discharge route is formed inside the rear block 42 as shown in FIG. 2.

Though the intake route for leading the fuel into the fuel room 36 is not shown in FIG. 7, the intake route is formed inside the rear block 42 as shown in FIG. 2.

The relief valve 206 is placed at the center of the cylinder block 15. In case that the fuel pressure inside the high pressure room 43 becomes extremely high, the ball 208 is pushed by the highly-pressurized fuel, and the fuel is made to be released into the fuel room 36 under lower pressure.

The wobble center 7*a* is defined to be located at the center of the extension of the bellows 40 in its longitudinal direction and on the axial center.

According to this embodiment as described above, the reliability can be made to be higher by lubricating the drive part with the lubricating fluid, and the pressure pulsation can be reduced to be small enough by using multi-cylinder pistons. In addition, the size of the fuel pump can be reduced with the configuration in which all the multiple-cylinder pistons are isolated at large.

Using the structure that the cylinder bore is formed as a penetration hole and the penetration hole is partially plugged by the valve sheet, the piston can be easily inserted into the cylinder bore, and hence, the fabrication of the fuel pump can be made to be easier.

By using the U-letter molded bellows, the stress generated in the bellows can be reduced as much as possible.

The stress generated in the top and bottom part of the bellows can be reduced.

As the drive room for converting the revolution movement to the reciprocating movement is filled with the lubricating oil, the reliability of the drive room can be increased.

By using the structure enabling to extract the air contained in the gasoline, the amount of discharged gasoline from the fuel pump can be kept constant.

As the fuel room is located inside the bellows and the drive room is located outside the bellows, the leakage of the gasoline outside atmosphere can be effectively protected. Therefore, casting parts can be used as the material for the front body, and ultimately, the productivity of the fuel pump can be increased.

What is claimed is:

1. A high pressure fuel pump, comprising:

a cup-shaped front body having a bottom;

a bearing device provided in a bottom portion of said front body;

a drive mechanism housed within said front body and, having a rotary shaft and a swing mechanism for converting rotating motion of said rotary shaft into a reciprocating motion;

a pump mechanism sealingly fixed on an opening end portion of said front body and having a cylinder configured to accept a piston to be reciprocally driven by said driving mechanism; and a flexible seal member sealingly fixed on non-rotating portion of said drive mechanism and dividing the interior of said front body into a drive mechanism chamber and a pump mechanism chamber.

2. The fuel pump according to claim 1, wherein said seal member comprises a bellows configured such that an inside of said bellows is said pump mechanism chamber and an outside of said bellows is said drive mechanism chamber.

3. The fuel pump according to claim 1, wherein a chamber surrounded by said flexible seal member and inner walls of said cup-shaped front body is filled with a lubricating oil.

4. The fuel pump according to claim 1, wherein a chamber surrounded by said flexible seal member and said pump mechanism is arranged for the introduction of gasoline.

* * * * *